United States Patent [19]

Komori et al.

[11] 4,190,464

[45] Feb. 26, 1980

[54] METHOD FOR CLEANING A PHOTOCONDUCTIVE SURFACE WITH LIQUID TONER

[75] Inventors: Shigehiro Komori; Hisashi Sakamaki, both of Yokohama; Hiroyuki Hattori, Mitaka; Toshihide Iida; Koichi Miyamoto, both of Tokyo; Kazumi Umezawa, Yokohama, all of Japan

[73] Assignee: Canon Kabushiki Kaisha, Tokyo, Japan

[21] Appl. No.: 860,457

[22] Filed: Dec. 14, 1977

Related U.S. Application Data

[60] Continuation of Ser. No. 588,228, Jun. 19, 1975, abandoned, which is a division of Ser. No. 583,247, Jun. 3, 1975, Pat. No. 4,009,955, which is a continuation of Ser. No. 461,104, Apr. 15, 1974, abandoned, which is a continuation of Ser. No. 258,820, Jun. 1, 1972, Pat. No. 3,804,512.

[30] Foreign Application Priority Data

| | | | |
|---|---|---|---|
| Jun. 3, 1971 | [JP] | Japan | 46-38917 |
| Jun. 3, 1971 | [JP] | Japan | 46-38918 |
| Jun. 9, 1971 | [JP] | Japan | 46-48632[U] |
| Jun. 10, 1971 | [JP] | Japan | 46-41195 |
| Jun. 10, 1971 | [JP] | Japan | 46-41196 |
| Jun. 10, 1971 | [JP] | Japan | 46-41197 |
| Jun. 21, 1971 | [JP] | Japan | 46-44611 |
| Aug. 30, 1971 | [JP] | Japan | 46-6674 |

[51] Int. Cl.[2] ..... B08B 3/12; B08B 6/00; G03G 21/00; B08B 7/00

[52] U.S. Cl. ..... 134/6; 118/652; 355/15

[58] Field of Search ..... 355/10, 14, 15; 427/15; 118/652; 134/1, 6

[56] References Cited

U.S. PATENT DOCUMENTS

| | | | |
|---|---|---|---|
| 2,889,758 | 6/1959 | Bolton | 355/15 X |
| 3,637,306 | 1/1972 | Cooper | 355/15 |
| 3,647,293 | 3/1972 | Queener | 355/15 |
| 3,711,796 | 1/1973 | Saito et al. | 355/15 |
| 3,725,059 | 4/1973 | Komp | 355/15 X |
| 3,759,220 | 9/1973 | Saito et al. | 427/15 X |
| 3,776,632 | 12/1973 | Smith et al. | 355/15 |
| 3,859,691 | 1/1975 | Katayama et al. | 15/256.51 |

*Primary Examiner*—Fred L. Braun

*Attorney, Agent, or Firm*—Fitzpatrick, Cella, Harper & Scinto

[57] ABSTRACT

An image forming device having a rotatable medium, a latent image forming device for forming a latent image on the rotatable medium, apparatus for applying liquid developer to the latent image to form a toner image, apparatus to transfer the toner image to transfer material and a cleaning apparatus for cleaning the rotatable medium after transfer. The device is operated so that there is an initial application of developer to the cleaning apparatus to loosen any dried toner after which the rotatable medium undergoes a prerotation of at least one half of a complete rotation before image formation is begun. After termination of an image forming operation, the rotatable medium is rotated for a predetermined time to clean its surface and then stopped.

29 Claims, 6 Drawing Figures

METHOD FOR CLEANING A PHOTOCONDUCTIVE SURFACE WITH LIQUID TONER

This is a continuation of application Ser. No. 588,228 filed June 19, 1975, now abandoned, which in turn is a division of Ser. No. 583,247, filed June 3, 1975, now U.S. Pat. No. 4,009,955 issued Mar. 1, 1977, which in turn is a continuation of Ser. No. 461,104 filed Apr. 15, 1974, now abandoned, which in turn is a continuation of Ser. No. 258,820 filed June 1, 1972, now U.S. Pat. No. 3,804,512 issued Apr. 16, 1974.

BACKGROUND OF THE INVENTION

1. Field of the Invention

This invention relates to a copying apparatus for copying both sheet originals and thicker originals, and more particularly to an epoch-making copying apparatus which is capable of high-speed copy production and which incorporates various novel process means.

2. Description of the Prior Art

The conventional copying machines are generally classified into two types, one of which is only able to copy sheet originals and the other is meant to copy three-dimensional originals such as books and the like.

The copiers exclusively for use with sheet originals cannot copy books or other thicker originals but are meritorious in that sheet originals can be rapidly copied simply by feeding them into an inlet for insertion and that there is no return stroke for the original carriage or the optical system during the same process, thus enhancing the copying speed correspondingly or approximately twice. These copiers have further merits in the simplicity and low cost of the entire construction, and also in the readiness with which an automatic original supply means may be added if required.

The other type of copiers, i.e. those for copying books or thicker originals have a great characteristic that they can copy both sheet originals and thicker originals. However, their construction is such that any original to be copied must be flatly spread over the original carriage, and such constructions unavoidably leads to cumbersome procedures of raising the original keep cover to place each sheet original on the original carriage, closing the keep cover and depressing the copy button, as is required to copy thicker originals. Moreover, the original carriage or the optical system operatively involves its return stroke, which means a corresponding loss of time and accordingly a corresponding reduction in copying speed for the same process. Additionally, mechanisms are not only complicated and expensive but also great difficulties will be encountered in incorporating an automatic original supply means.

For these reasons, the foregoing two conventional types of copying machines have been enjoying their unique markets, respectively.

In most offices, however, demand for copies of sheet originals is greater than that for copies of thicker originals. For this reason, those offices had to resort to copying machines for thick originals which are more expensive and less convenient to copy sheet originals.

To overcome such irrationality, there have heretofore been proposed copying apparatuses which are capable of copying thicker originals while maintaining their merits as sheet original copying apparatus. Such apparatuses are grouped into the following two types:

I. The apparatus portion overlying the path of sheet originals is detachably constructed so that when copying thicker originals, such portion may be detached from the apparatus body so as to expose the sheet original transport rolls of the apparatus body. A thicker original may be manually urged against such exposed transport rolls and transported with the aid of the rubber rolls so as to be subjected to a through-slit exposure.

II. This type is substantially identical in construction with the type I except in that there is additionally provided a carrier comprising a transparent plate of glass or plastics, on which a thicker original may be placed and transported for exposure with the edges of the carrier held by two or more pairs of transport rolls.

These two types of apparatuses are substantially similar to the sheet original copying machines in construction and accordingly in cost, but suffer from some demerits as follows:

(1) From the user's point of view, removal of an appratus portion means a considerably cumbersome procedure, and also would encounter a difficulty in providing a storage space therefor if the entire office space is limited. In case of type II, storage of the carrier would also be troublesome.

(2) In case of type I, the variable manual pressure imparted to the original may cause a great variation in the load to the drive of the apparatus body. In case of type II, the thickness of the carrier may cause a corresponding variation in the length of the optical path, which in turn would result in erroneous focusing and accordingly erroneous synchronization, thus seriously affecting the quality of the resultant copies.

(3) A gear sprocket wheel located at the end of original transport rolls for driving such rolls, and further in case of type II, carrier transport rolls, would project outwardly of the path for originals, thus preventing such path from being flat and accordingly preventing a portion of a bulky original from being copied.

(4) Where the original to be copied has a substantial thickness like books and the leading edge of the original (as viewed in the direction of movement thereof) has a complicated configuration (due to the book cover or the opened position of the book with the page margins thereof forming a slope), the position for the leading edge of the resultant copy image may be greatly variable because the leading edge of the book or like original is detected by a detector switch designed for detecting the leading edges of sheet originals.

Thus, the copying apparatuses of the types as mentioned under items I and II above are practically unsatisfactory and even their merits are merely nominal.

SUMMARY OF THE INVENTION

The present invention eliminates all the disadvantages mentioned above, and includes improvements in the various components of a copying apparatus.

An object of the present invention is to provide a copying apparatus which can fully function both as sheet original copier and thick original copier and also can increase the copying speed in accordance with the variable size of copies.

The copying apparatus of the present invention is of the type using the liquid development and image transfer system and is of such construction that sheet originals and thicker originals such as books and the like may equally be copied with ease.

Where sheet originals are to be copied by the copying apparatus of the present invention, a sheet original is inserted into the nip between sheet original transport rolls rotating in synchronism with a photosensitive drum normally rotated after a predetermined time of start preparation has passed, as will further be described. The leading edge of the sheet original is detected by detector means including a lamp and light receiving element, whereupon the transport rolls are temporarily stopped, thus stopping the original sheet. When the rotating photosensitive drum comes to a predetermined position, an original start signal is produced from the photosensitive drum to rotate the transport rolls again, so that the original is transported in synchronism with the photosensitive drum and finally discharged out of the apparatus by transport means such as rolls. During such travel, the original passes through an illuminating station. The photosensitive drum is normally rotating in one direction. The photosensitive drum passes through suitable copying processes to form a latent image thereon and reaches a developing means, which comprises a developing liquid tank, means such as pump or the like for stirring and raising developing liquid, and a developing electrode. This electrode is adapted to be urged toward the photosensitive drum by spring means with a very slight clearance maintained therebetween. The latent image formed on the photosensitive drum is developed into a visual image by toner contained in the developing liquid raised onto the developing electrode by said pump or like means. The excess developing liquid left on the photosensitive drum is removed by a post charger without disturbing the formed image. Subsequently, a transfer medium fed from paper feed means is brought into intimate contact with the surface of the photosensitive drum so that the image on the drum is transferred to the transfer medium as the latter is electrically charged. Thereafter, the transfer medium is separated from the photosensitive drum by a separator belt and directed to a drying-fixing station. Any residual developing liquid with toner remaining on the photosensitive drum is wiped off by the edge portion of a blade cleaner urged into contact with the photosensitive drum, thus making the drum ready for reuse in the next cycle. The developing liquid thus wiped off by the blade cleaner flows along grooves formed around the opposite end portions of the photosensitive drum and down into the developing means for reuse.

Where book or thicker originals (hereinafter referred to as "book originals") are to be copied, the copying apparatus is changed over from the above-described sheet original copying mode to a book original copying mode. Such mode change-over may be accomplished by depressing a change-over button to cause means such as lever and projection to release a cam on the underside of the original carriage from its sheet original copying position, thus displacing the original carriage into its book original copying position. With such movement of the original carriage from its sheet original copying position into its book original copying position, the drive and electric supply to the sheet original transport means is cut off to thereby change over the circuit into a mode for book originals. In the book original copying mode, the leading edge of a book original assumes the position which was previously occupied by the detector means in the sheet original copying mode. A book original to be copied is placed on the original carriage with the leading edges of the original and carriage registered with each other, whereafter the original is covered with an original keep cover and the copy button is depressed. As described with respect to the sheet original copying mode, a start signal is produced from the photosensitive drum to energize means such as electromagnetic plunger, thus starting to drive the original carriage reciprocally. A through-slit exposure takes place in synchronism with the peripheral speed of the photosensitive drum. After the exposure, the original carriage reverts to its return stroke in response to a signal produced from itself in accordance with the size of the original. The speed for the return stroke is higher than the speed for the forward stroke to enhance the copying speed. If multiple copies of the same book original are to be obtained continuously, the copy button is maintained depressed until a preset number of copies has been counted up by counter means for counting such number, thus providing any desired number of copies. In the other points, the operation in the book original copying mode is identical with that in the sheet original copying mode.

The start preparation preceding to the ordinary copying operation and the rest position and re-start succeeding to the completion of the copying operation will now be described briefly.

In the copying apparatus of the present invention which utilizes the liquid development system, a very small amount of toner usually tends to build up in the neighborhood of the edge portion of the blade cleaner used to clean the photosensitive drum so as to remove the residual developing liquid with toner after the image transfer. If the apparatus is stopped and left under such condition for many hours, the carrier collected at the edge portion would evaporate to solidify the toner. If the apparatus is re-started to rotate the drum under such condition, the solidified toner would injure the edge of the cleaner and/or the surface of the photosensitive drum or might adversely affect the formed image on the drum surface. For these reasons, the copying apparatus of the present invention is arranged so that closing of the main switch does not result in rotation of the drum but only allows rotation of the pump in the developing means to stir and introduce the developing liquid upwardly into a liquid supply pipe so as to pour onto the blade cleaner. After the solidified toner at and near the cleaner's edge portion is fluidized in a predetermined time, the photosensitive drum begins to rotate and the fluidized toner is wiped off.

On the other hand, if the power source should be left connected even after completion of the copying cycles, the photosensitive drum will continue its rotation and this is undesirable in respect of the service life of the drum and/or the blade cleaner. To avoid this, the copying apparatus of the present invention is also arranged so that when no further copying cycle is wanted after a previous one, the drum may be automatically stopped into a rest position irrespective of the closed position of the main switch. In such rest position, depression of the re-start switch in the operating portion will return all the apparatus parts to the position which was taken before the rest position.

BRIEF DESCRIPTION OF THE DRAWINGS

The invention will become fully apparent from the following detailed description of various embodiments thereof taken in conjunction with the accompanying drawings, in which.

DESCRIPTION OF THE PREFERRED EMBODIMENTS

The copying apparatus of the present invention is of the liquid development and transfer type which can selectively copy sheet originals such as documents and the like or thicker originals such as books and the like, as desired.

Figure 1:
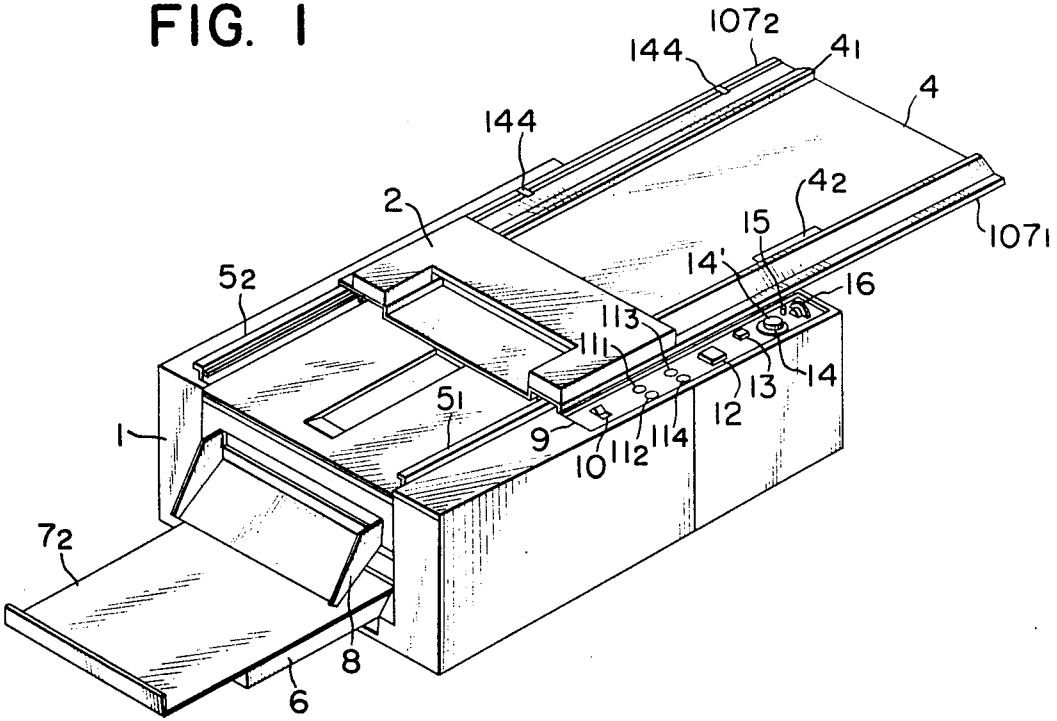
FIG. 1 is a perspective view showing an embodiment of the copying apparatus according to the present invention.

Referring to FIG. 1, an embodiment of the copying apparatus according to the present invention includes a housing 1, a sheet original transport means 2, and an original carriage 3 for supporting thereon a thick original (hereinafter referred to as "book original") and covered with an original keep cover 4. The apparatus further includes a pair of guide rails $5_1$ and $5_2$ for the original carriage, a cassette 6 containing therein a stock of transfer paper sheets P, and a lid 7 for the cassette which may also serve as a tray for receiving transfer paper sheets discharged out of the apparatus after image transfer. There are further seen an auxiliary tray 8, an operating portion 9 including a main switch 10, a group of alarm lamps $11_1$–$11_4$, a re-start lamp switch 12 which is to be further described, a button 13 for changing over the mode of operation between a mode for copying sheet originals and a mode for copying book originals, a knob and copy button 14 for selecting a mode for continuously producing multiple copies of a book original, a button 15 for urgently stopping the continuous copy mode for a book original, and a dial 16 for adjusting the density of desired copies.

Figure 2:
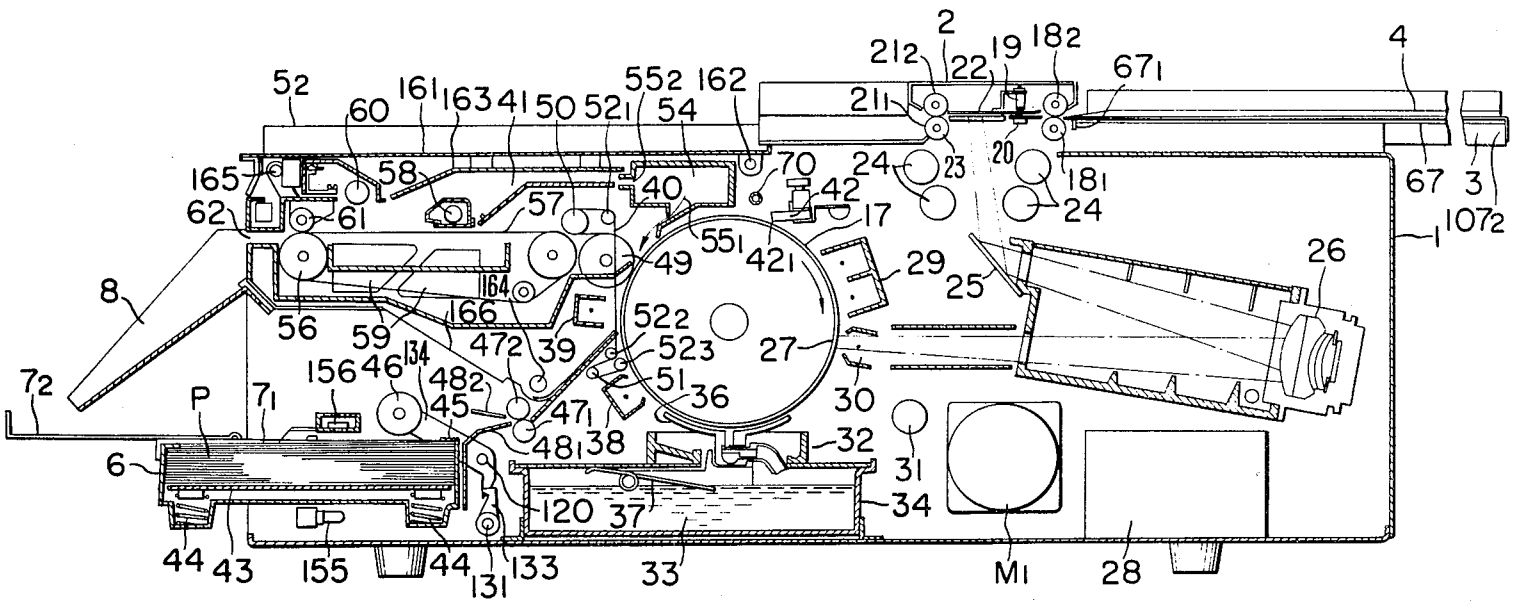
FIG. 2 is a longitudinal section thereof.

With reference to FIG. 2, the operation of such copying apparatus will first be described as to the case where sheet originals are to be copied. A sheet original is inserted from the right of the apparatus into the nip between the rolls $18_1$ and $18_2$ of the sheet original transport means 2 which are rotated in synchronism with a photosensitive drum 17 which is normally rotated after a certain time for start preparation as will be described later, and then the inserted sheet original is transported leftwardly. As soon as the leading edge of the sheet original is detected by a lamp 19 and a light receiving element 20, the rolls $18_1$ and $18_2$ are temporarily stopped from rotating, and thus the original is also stopped. Subsequently, when the photosensitive drum 17 comes to a predetermined position, a start signal for the original is produced to rotate the rolls $18_1$ and $18_2$ again so that the original is further transported leftwardly in synchronism with the rotation of the photosensitive drum 17, whereafter it is discharged upwardly by rolls $21_1$ and $21_2$. During that time, the original is illuminated from therebelow at an illuminating station 22 by four lamps 24 as it is moved on a glass plate. The image of the original is optically directed by a mirror 25 and a mirror lens 26 through an exposure station 27 to the surface of the photosensitive drum 17, thus forming an image thereon.

Figure 5:
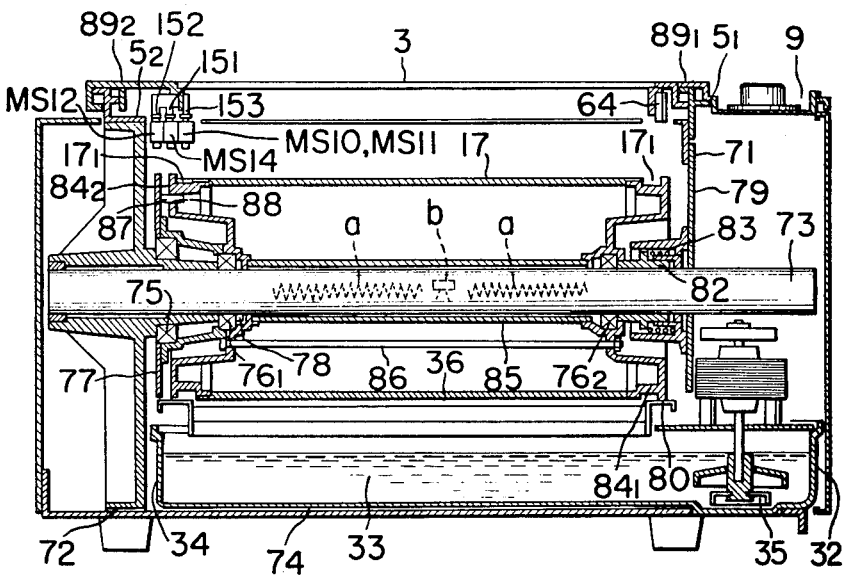
FIG. 5 is a transverse section of the same apparatus.

The photosensitive drum 17 comprises a photosensitive layer covered with a transparent dielectric layer and is normally rotated in clockwise direction as viewed in FIG. 2. The photosensitive drum 17 is first charged with positive polarity by a primary charger 29 supplied with a high voltage of positive polarity from a high voltage source 28. When the charged surface portion of the photosensitive drum 17 comes to the exposure station 27, the image from the illuminating station is projected on such portion of the drum 17 through a slit while it is discharged by an AC discharger 30 supplied with a high AC voltage from the high voltage source 28. Then that surface portion of the photosensitive drum 17 is subjected to an overall exposure by a lamp 31, thus forming an electrostatic latent image on the surface portion thereof, whereafter the image carrying surface portion of the photosensitive drum 17 enters a developing means 32. The developing means 32 comprises a container 34 for containing a body of developing liquid 33, a pump 35 (FIG. 5) for stirring and raising the developing liquid, and an electrode 36 normally biased toward the photosensitive drum by a spring 37 so as to maintain a slight clearance with respect to the drum surface. The electrostatic latent image formed on the photosensitive drum 17 is developed into a visible image with the aid of toner particles contained in the developing liquid and raised onto the electrode 36 by the pump 35.

Subsequently, at a post charger 38, the image carrying surface portion of the photosensitive drum 17 is charged with a negative high voltage from the high voltage source to remove the excess liquid from the surface of the photosensitive drum 17 without disturbing the developed image thereon. Thereafter, a sheet or transfer paper P is fed from a paper feed station and brought into intimate contact with the image carrying surface of the photosensitive drum 17 so that the image on the photosensitive drum 17 is transferred onto the sheet of transfer paper P with the aid of a positive high voltage applied thereto at a transfer charger 39 from the voltage source 28. After the image transfer, the transfer paper P is separated from the photosensitive drum 17 by a separator belt 40, and then directed to a drying-fixing station 41. The photosensitive drum 17 is cleaned by the edge portion $42_1$ of a blade cleaner 42 urged into contact with the drum 17 to remove any residual amount of liquid with toner, thus becoming ready for a subsequent cycle of copying operation. The developing liquid as removed from the photosensitive drum 17 by the blade cleaner 42 flows along grooves $17_1$ formed around the opposite ends of the drum 17, and thence into the developing means 32 for reuse.

On the other hand, sheets of transfer paper P are contained in the cassette 6 which is removably mounted to the apparatus. Various types of cassettes may be available in accordance with various sizes of transfer sheet and may be readily interchangeable as desired. The sheets of transfer paper P are supported on an inner plate 43 within the cassette 6 and the inner plate 43 is biased upwardly by a spring 44 so as to normally urge the pile of transfer paper P against separator pawls 45 formed on the forward end of the cassette at the opposite sides thereof. By suitably selecting the spring constant of the spring 44, the pressure force with which the sheets of transfer paper P are urged against the separator pawl 45 may be maintained substantially constant irrespective of the number of the transfer paper sheets P in the cassette 6.

When the photosensitive drum reaches its predetermined position, a signal is produced to lower a normally rotating paper feed roll 46 into contact with the uppermost sheet of transfer paper P so that the paper feed roll 46 cooperates with the separator pawl 45 to separate the uppermost transfer paper sheet P from the others and feed it leftwardly as viewed in FIG. 2. However, since register rolls $47_1$ and $47_2$ located adjacent to the cassette are stopped immediately after the feed roll 46 has been lowered, the transfer paper P fed out of the cassette 6 tends to be slack between guides $48_1$ and $48_2$ with the leading edge thereof bearing against the area of contact between the register rolls $47_1$ and $47_2$. Immediately thereafter, the photosensitive drum 17 produces a paper feed signal, in response to which the register rolls $47_1$ and $47_2$ start to rotate, thus feeding the transfer paper P at a speed equal to the peripheral speed of the photosensitive drum 17. On the other hand, the paper feed roll 46 is again raised away from the stock of transfer paper P after a predetermined time, and thereafter the separated transfer paper is continuously fed only by the register rolls $47_1$, $47_2$ and subsequent feed means.

Figure 3:
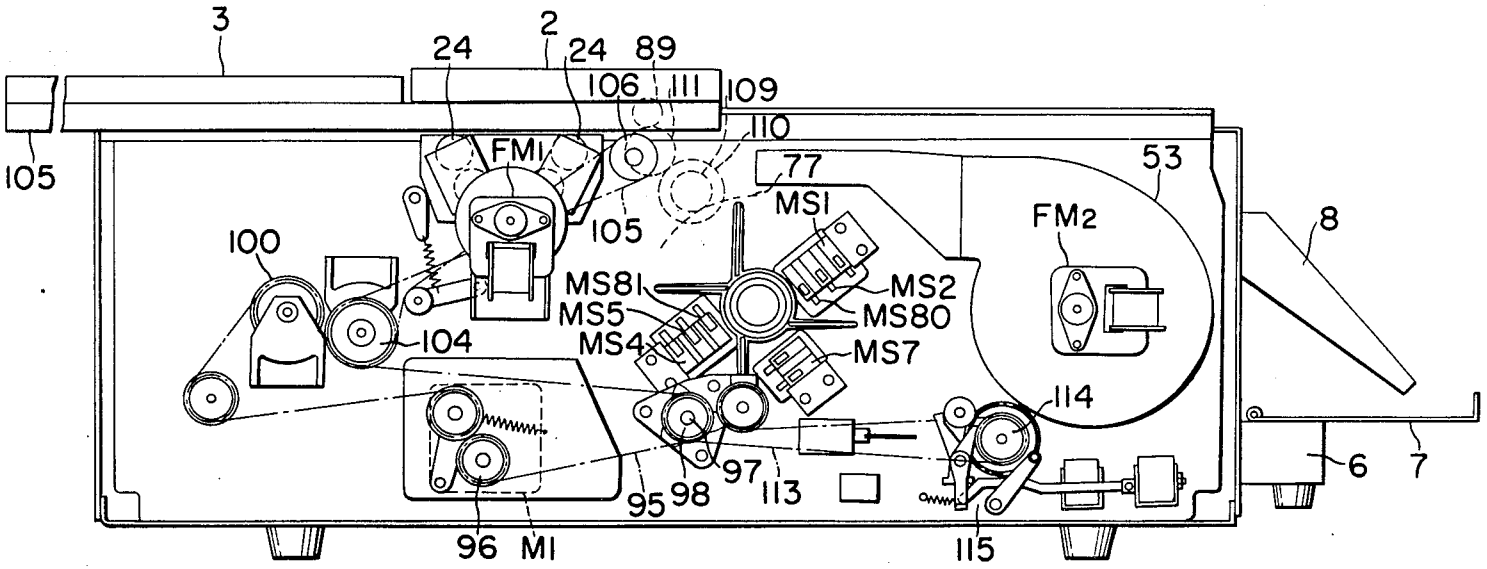
FIG. 3 is a rear side view of the FIG. 2 apparatus with the rear side cover removed therefrom.

The transfer paper separator belt 40 may be in the form of a narrow endless belt which passes from a separator roll 49 disposed in very closely spaced relationship with the photosensitive drum 17, and over a deflecting pulley 50, pulleys $52_1$, $52_2$, deflecting pulley 51, pulley $52_3$ back to the separator roll 41. The portion of the separator belt 40 extending between the pulley $52_3$ and the separator roll 49 bears against the drum 17 at a portion thereof corresponding to one end of the transfer paper sheet, and the portion of the separator belt 40 extending between the pulleys $52_1$ and $52_2$ is caused by the deflecting pulleys 50, 51 to follow a path deviated from the path of the transfer paper. The separator belt 40 is driven by the separator roll 49 at a speed substantially equal to the speed of the photosensitive drum 17. A portion of the separator belt 40 is sandwiched between one side edge of a transfer paper sheet P and the outer surface of the photosensitive drum 17 when the transfer paper P is brought into intimate contact with the photosensitive drum 17 during the image transfer process. Thus, the separation of the separator belt 40 from the photosensitive drum 17 as accomplished at the separator roll 49 will force one side edge of the transfer paper sheet P to be also separated from the photosensitive drum 17. Once its side edge is so separated, the transfer paper P may be entirely separated from the photosensitive drum 17 owing to its own self-supporting strength and to the action of the air blown from a blower 53 (FIG. 3) via a duct 54 and through an air outlet $55_1$, whereafter the transfer paper may be passed toward the drying-fixing station 41.

At the drying-fixing station 41, the unfixed transfer paper P is conveyed on a conveyor belt 57 driven by a roll 56, in the leftward direction as viewed in FIG. 2, so that the paper P is dried and fixed by the air blown from the duct 54 and intensely heated just below a heater 58. Most of the air thus heated by the heater 58 and consumed for the drying is sucked into the blower 53 (FIG. 3) through an intake port 59 disposed below the belt 57 so that such air may be circulated for reuse in the drying and fixing process. The transfer paper P thus dried and fixed may be electrically discharged by a discharger 60 so as to remove any residual charge from the surface of the paper P, whereafter it is passed via a discharge roll 61 to a discharge port 62 and discharged therethrough onto the lid 7 of the cassette 6 which also serves as a reception tray.

Figure 4:
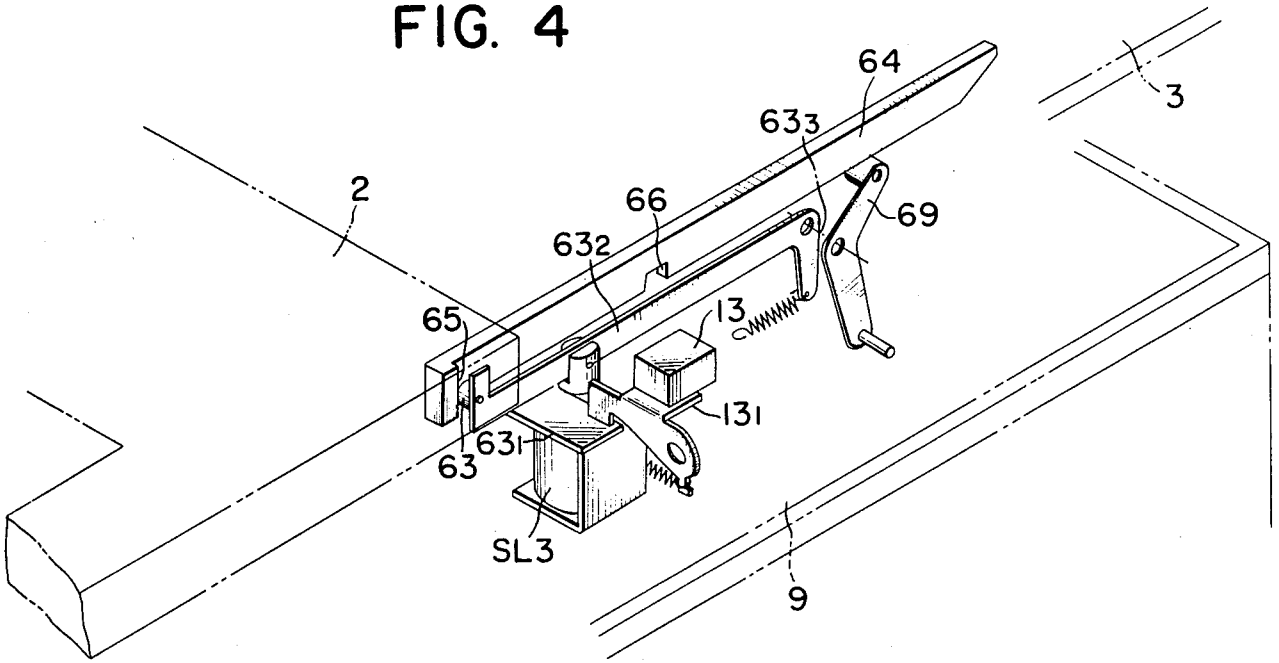
FIG. 4 is a fragmentary perspective view showing the mechanism for fixing the original carriage.

With reference to FIG. 4, description will now be made of the operation of the above-described apparatus when used to copy book originals. The change-over of the operation mode from the foregoing mode for copying sheet originals to a mode for copying book originals may be accomplished in the manner described hereunder. The change-over button 13 is first depressed to cause counter-clockwise pivotal movement of a lever $63_2$ about a pin $63_3$ through the cooperation between a lever $13_1$ and a projection $63_1$ integral with the lever $63_2$, thus lowering a roll 63 to disengage this roll 63 downwardly from a heat original positioning groove 65 formed at one end of a cam 64 mounted to the lower portion of the original carriage 3, which is thus allowed to move leftwardly as viewed in FIG. 2 until the roll 63 is received into a book original positioning groove 66. Such movement of the original carriage 3 from its position for sheet originals to its position for book originals cuts off the supply of electrical drive to the sheet original transport means 2, thereby changing over the entire circuit to the book original copying position. In this operative position, the forward end of a book original to be copied, i.e. the forward end $67_1$ of the original carriage's glass plate 67 (FIG. 2) assumes the position which was occupied by the lamp 19 and light receiving element 20 in the sheet original copying mode.

A book original to be copied is placed on the carriage's glass plate 67 with the forward end thereof registered with the forward end $67_1$ of the glass plate, and then the book original is held by the keep cover 4 (FIG. 2). Thereafter, the copy button 14' (FIG. 1) is depressed to produce an original start signal from the photosensitive drum 17 in the same way as described above with respect to the case of sheet original. This signal energizes an electromagnetic plunger SL3 so that upon disengagement of the roll 63 from the groove 66 the original carriage 3 is moved leftwardly as viewed in FIG. 2 and at the same speed as the peripheral speed of the photosensitive drum 17 to accomplish a through-slit exposure. Upon completion of such exposure, the original carriage 3 stops its leftward movement in response to its own signal corresponding to the size of the book original, whereupon the carriage 3 assumes its backward or rightward movement. The speed of this return movement is higher than the speed of the forward movement to increase the copying efficiency. Upon return of the original carriage to its initial position for the book original copying, the drive to the original carriage 3 is cut off to stop it with the roll 63 received in the groove 66.

Where multiple copies of the same book original are to be obtained continuously, this may readily be accomplished by means of counter means 14 operatively associated with the copy button 14'. The counter means 14 converts the movement of the original carriage 3 into a count through the cam 64 and crank 69 shown in FIG. 4, so as to hold the copy button 14' in depressed position until a preset number of copies has been counted up, thus enabling multiple copies to be provided.

In the other points, the operation of the apparatus for book originals is identical with that for sheet originals.

In the present embodiment of the copying apparatus, the photosensitive drum 17 can copy originals of variable width up to that of JIS (Japanese Industrial Standard) A3 format and has a circumferential length somewhat greater than the length of the A3 format. Therefore, where the originals to be copied are sheet originals, one of sheet originals of A3 format may be fed for copying per full rotation of the photosensitive drum or two of sheet originals of A4 format may be fed at a time in a direction perpendicular to the longitudinal axis thereof. If book originals are to be copied, the forward stroke (exposure stroke) of the original carriage 3 is followed by the return stroke which requires substantially as much time as the forward stroke, and thus the length of time required for providing one copy of a book original will be approximately twice the time required for one copy of a sheet original. More specifically, for originals of A3 format, one copy may be provided every two full rotations of the photosensitive drum, and for originals of A4 format, one copy may be provided per full rotation of the photosensitive drum.

Such cycle difference arising from the different sizes of paper may be detected by a signal from the cassette 6, and the cycle difference arising from the different types of original may be detected by a signal resulting from the change in position of the original carriage.

Description will now be made of the start preparation preceding to an ordinary copying cycle and of the rest position and restart succeeding to the completion of one copying cycle. As has been described above, the copying apparatus of the present embodiment is of the liquid development type whereby toner particles in the developing liquid are fixed by evaporation and desiccation of carrier liquid. Also, the blade cleaner 42, which may be formed of elastomer such as urethane rubber, nitride rubber, fluorine rubber, polysulfide rubber, acrylic rubber or the like and which is used to clean the photosensitive drum 17 to remove the toner or developing liquid remaining thereon after the image transfer, usually tends to permit a very small amount of toner to build up in the neighborhood of the cleaner's edge portion $42_1$. If the apparatus is stopped and left under such condition for many hours, the carrier collected at the edge portion $42_1$ would evaporate to solidify the toner. If the apparatus is re-started to rotate the drum 17 under such condition, the solidified toner would injure the edge $42_1$ of the cleaner 42 and/or the surface of the photosensitive drum 17 or might adversely affect the formed image on the drum surface. For these reasons, the copying apparatus of the present embodiment is arranged so that closing of the main switch 10 does not result in rotation of the drum 17 but only allows rotation of the pump in the developing means 32 (FIG. 5) to stir and introduce the developing liquid 33 upwardly into a liquid supply pipe 70 (FIG. 2) so as to pour into the blade cleaner 42. After the solidified toner at and near the cleaner's edge portion $42_1$ is fluidized in a predetermined time, the photosensitive drum 17 begins to rotate and the fluidised toner is wiped off. After the photosensitive drum 17 has made at least one-half rotation, the rolls $18_1$ and $18_2$ of the sheet original transport means 2 begin to rotate and enable a copying cycle to take place.

On the other hand, if the power source should be left connected even after completion of the copying cycles, the photosensitive drum 17 will continue its rotation and this is not desirable in respect of the service life of the drum 17 and/or the blade cleaner 42. To avoid this, the copying apparatus of the present embodiment is also arranged so that when no further copying cycle is wanted after a previous one, the drum 17 may be automatically stopped into a rest position irrespective of "ON" position of the main switch 10. The time allowed for such rest position is selected to a value longer than the time required for a sheet of transfer paper P with a copy image thereon to be discharged out of the apparatus and for the entire surface of the photosensitive drum 17 to be cleaned up. In such rest position, depression of the re-start switch 12 in the operating portion 9 will return all the apparatus parts to the position which was taken before the rest position.

Figure 6:
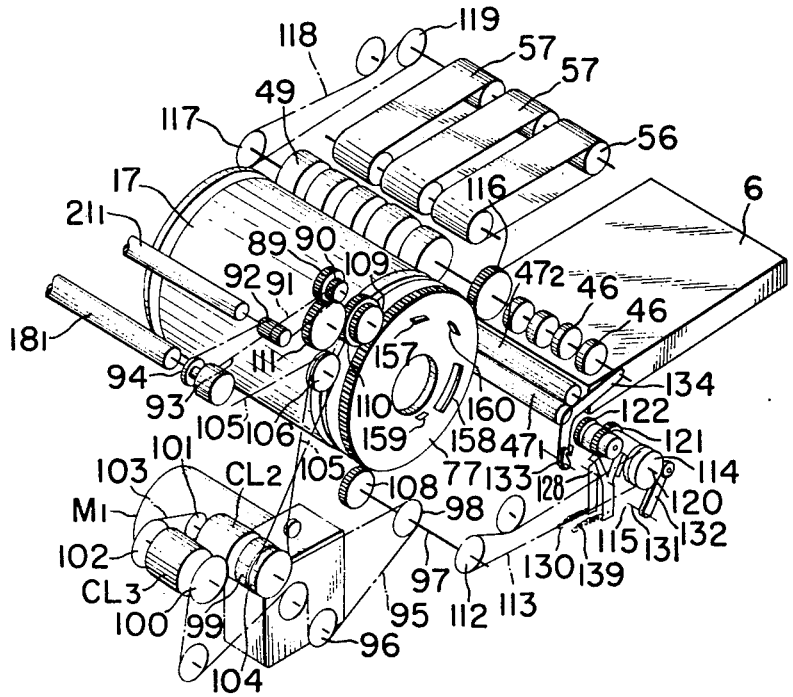
FIG. 6 is a perspective view for illustrating the drive system.

As shown in FIG. 6, the drum gear 77 is provided with a cam 157 adapted to actuate switches MS1 and MS4 to produce an original start signal, a cam 158 adapted to actuated switches MS2 and MS5 to produce a paper feed and register signal, a cam 159 adapted to actuate switches MSS1 and MSS2 to produce a jam detecting signal, and a cam 160 adapted to actuate a switch MS7 to produce a drum stop signal. The cam 160 is meant to predetermine the rest position for the drum and the portion of the drum which is to be stained with the cleaning blade during its rest position. The present embodiment is so designed that such stained portion of the drum may not be used as an image forming area.

We claim:

1. A method of operating an electrophotographic machine including a rotatable medium, electrostatic latent image means for forming an electrostatic latent image on said rotatable medium, liquid developer means for applying liquid developer to the electrostatic latent image to form a toner image thereof on said medium, transfer means for transferring the toner image from said rotatable medium to transfer material, cleaning means, including a cleaning blade, contacting said rotatable medium for cleaning same for repetitive use, and means for supplying cleaning liquid to the contact area between said cleaning means and said rotatable medium, said electrostatic latent image means, liquid developer means, transfer means and cleaning means being disposed sequentially along the path of movement of said rotatable medium in the direction of rotation, said method comprising:

(a) supplying, once said machine starts to operate, cleaning liquid onto said contact area for a predetermined period of time while said rotatable medium is maintained in a fixed position; then (b) rotating said rotatable medium through a predetermined angle while said cleaning means is being operated for wet-cleaning, wherein said angle corresponds to at least one half of a full rotation; and then (c) enabling said machine to carry out an image-forming operation.

2. A method according to claim 1, wherein the operation of said cleaning means during the rotation of said rotatable medium is effected by contacting said rotatable medium with said cleaning blade at a position wherein said rotatable medium rotates downwardly, and wherein the application of liquid developer is effected at a location below said position.

3. A method of operating an electrophotographic machine including a rotatable medium, electrostatic latent image means for forming an electrostatic latent image on said rotatable medium, liquid developer means for applying liquid developer to the electrostatic latent image to form a toner image thereof on said rotatable medium, transfer means for transferring the toner image from said rotatable medium to transfer material, cleaning means, including a cleaning blade, for cleaniing said rotatable medium for repetitive use, and means for wetting the surface of said rotatable medium, said electrostatic latent image means, liquid developer means, transfer means and cleaning means being disposed sequentially along the path of movement of said rotatable medium in the direction of rotation, said method comprising:

(a) rotating, once said machine starts to operate, said rotatable medium through a predetermined angle while said cleaning means is being operated for wet-cleaning, wherein said angle defines at least one half of a full rotation; then (b) forming an electrostatic latent image on said rotatable medium; and then (c) developing the electrostatic latent image with liquid developer to form a toner image and transferring the toner image to transfer material.

4. A method according to claim 3, wherein the operation of said cleaning means during the rotation of said rotatable medium is effected by contacting said rotatable medium with said cleaning blade at a position wherein said rotatable medium rotates downwardly, and wherein the application of liquid developer is effected at a location below said position.

5. A method according to claim 3, wherein developer liquid is supplied by said wetting means to the contact area between said rotatable medium and said cleaning blade to facilitate wet-cleaning.

6. A method according to claim 3, wherein developer liquid is supplied by said wetting means to said cleaning means at a position wherein said rotatable medium rotates downwardly and wherein said developer means is located below said position.

7. A method of operating an electrophotographic machine including a rotatable medium, electrostatic latent image means for forming an electrostatic latent image on said rotatable medium, liquid developer means for applying liquid developer to the electrostatic latent image to form a toner image thereof on said rotatable medium, transfer means for transferring the toner image from said rotatable medium to transfer material, cleaning means for cleaning said rotatable medium for repetitive use, said cleaning means including means for wiping liquid developer therefrom, and means for wetting the surface of said rotatable medium, said electrostatic latent image means, liquid developer means, transfer means and cleaning means being disposed sequentially along the path of movement of said rotatable medium in the direction of rotation, said method comprising:

(a) rotating, once said machine starts to operate, said rotatable medium through a predetermined angle while said cleaning means is being operated for wet-cleaning, wherein said angle defines at least one half of a full rotation; then (b) forming an electrostatic latent image on said rotatable medium; then (c) developing the electrostatic latent image with liquid developer to form a toner image of said original and transferring the toner image to transfer material; and then (d) rotating said rotatable medium for a predetermined period of time while said cleaning means is being operated.

8. A method according to claim 7, wherein after said predetermined period of time, the rotation of said rotatable medium is stopped.

9. A method according to claim 7, wherein said wiping means includes a cleaning blade, and wherein the operation of said cleaning means during the rotation of said rotatable medium is effected by contacting said rotatable medium with said cleaning blade.

10. A method according to claim 7, wherein said wiping means includes a cleaning blade, wherein the operation of said cleaning means during the rotation of said rotatable medium is effected by contacting said rotatable medium with said cleaning blade at a position wherein said rotatable medium rotates downwardly, and wherein the application of liquid developer is effected at a location below said position.

11. A method according to claim 7, wherein said wiping means contacts said rotatable medium during cleaning and wherein developer liquid is supplied by said wetting means to the contact area between said rotatable medium and said wiping means to facilitate wet-cleaning.

12. A method according to claim 7, wherein developer liquid is supplied by said wetting means to said cleaning means at a position wherein said rotatable medium rotates downwardly and wherein such developer means is located below said position.

13. A method of operating an electrophotographic copying machine including a rotatable medium, electrostatic latent image means for forming an electrostatic latent image of an original to be copied on said rotatable medium, liquid developer means for applying liquid developer to the electrostatic latent image to form a toner image thereof on said rotatable medium, transfer means for transferring the toner image from said rotatable medium to copy material, cleaning means, including a cleaning blade contacting said rotatable medium, for cleaning same for repetitive use, and means for supplying cleaning liquid to the contact area between said cleaning blade and said rotatable medium, said electrostatic latent image means, liquid developer means, transfer means and cleaning means being disposed sequentially along the path of movement of said rotatable medium in the direction of rotation, said method comprising:

(a) rotating, once said machine starts to operate, said rotatable medium through a predetermined angle while said cleaning means is being operated and with the contact area wet, wherein said angle corresponds to at least one half of a full rotation; then (b) forming an electrostatic latent image of the original on said rotatable medium, then developing the electrostatic image with liquid developer to form a toner image of the original and transferring the toner image to copying material;

(c) repeating step (b) to make a predetermined number of copies of the original or of different originals; and then (d) rotating said rotatable medium for a predetermined period of time while said cleaning means is operated.

14. The method of claim 13, wherein after said predetermined period of time, rotation of said rotatable medium is stopped.

15. A method of operating an electrophotographic copying machine, as set forth in claim 13, wherein operation of said cleaning means during the rotation of the rotatable medium is effected by contacting said rotatable medium with said cleaning blade at a position wherein said rotatable medium rotates downwardly, and wherein the application of liquid developer is effected at a location below said position.

16. A method according to claim 13, wherein developer liquid is supplied by said supplying means to the contact area between said rotatable medium and said cleaning blade to facilitate wet-cleaning.

17. A method according to claim 13, wherein developer liquid is supplied by said supplying means to said cleaning blade at a position wherein said rotatable medium rotates downwardly and wherein said developer means is located below said position.

18. A method of operating an electrophotographic machine including a rotatable medium, electrostatic latent image means for forming an electrostatic latent image on said rotatable medium, liquid developer means for applying liquid developer to the electrostatic latent image to form a toner image thereof on said rotatable medium, transfer means for transferring the toner image from said rotatable medium to transfer material, cleaning means, including a cleaning blade contacting said rotatable medium, for cleaning same for repetitive use, and means for supplying cleaning liquid to the contact area between said cleaning blade and said rotatable medium along the path of movement of said rotatable medium, in the direction of rotation, said method comprising:

(a) supplying, once a main switch of said machine is actuated, said cleaning liquid to said contact area for a first predetermined period of time, while said rotatable medium is maintained in a fixed position in order to fluidize any solidified toner; then (b) rotating said rotatable medium, through a predetermined angle while said cleaning means is being operated and with the contact area wet, wherein said angle corresponds to at least one half of a full rotation; then (c) enabling said machine to carry out an image forming operation; then (d) forming, when an image forming operation is instructed, an electrostatic latent image on said rotatable medium and developing same with liquid developer to form a toner image, and then transferring the toner image to transfer material; and then (e) rotating said rotatable medium for a second predetermined period of time to clean said rotatable medium.

19. A method according to claim 18, wherein after said second period of time, the rotation of said rotatable medium is stopped.

20. A method according to claim 18, wherein the operation of said cleaning means during the rotation of said rotatable medium is effected by contacting said rotatable medium at a position wherein said rotatable medium rotates downwardly, and wherein the application of liquid developer is effected at a location below said position.

21. A method of operating an electrophotographic machine including a rotatable medium, electrostatic latent image means for forming an electrostatic latent image, liquid developer means for applying liquid developer to the electrostatic latent image to form a toner image thereof on said rotatable medium, transfer means for transferring the toner image from said rotatable medium to transfer material, cleaning means, including a cleaning blade, for cleaning said rotatable medium for repetitive use, said electrostatic latent image means, liquid developer means, transfer means and cleaning means being disposed sequentially along the path of movement of said rotatable medium in the direction of rotation, said method comprising:

(a) forming an electrostatic latent image on said rotatable medium; then (b) developing the electrostatic latent image with liquid developer to form a toner image of the original and transferring the toner image to transfer material;

(c) repeating steps (a) and (b) to make a predetermined number of copies of the original or of different originals while said cleaning means is being operated; then (d) rotating said rotatable medium, while said cleaning means is being operated, until its entire surface is cleaned by removal of the remaining toner and liquid from the surface of said rotatable medium; and then (e) stopping said rotatable medium.

22. A method according to claim 21, wherein the operation of said cleaning means during the rotation of said rotatable medium is effected by contacting said rotatable medium with said cleaning blade at a position wherein said rotatable medium rotates downwardly, and wherein the application of liquid developer is effected at a location below said position.

23. A method of operating an electrophotographic machine including a rotatable medium, electrostatic latent image means for forming an electrostatic latent image on said rotatable medium, liquid developer means for applying liquid developer to the electrostatic latent image to form a toner image thereof on said rotatable medium, transfer means for transferring the toner image from said rotatable medium to transfer material, cleaning means, including means for wiping the liquid developer off said rotatable medium, disposed to contact and clean said rotatable medium for repetitive use, and means for supplying cleaning liquid to the contact area between said cleaning means and said rotatable medium, wherein said image forming means, developer means, transfer means, and cleaning means are disposed sequentially along the path of movement of said rotatable medium, in the direction of rotation thereof, said method comprising:

(a) rotating, once operation of said machine is started, said rotatable medium through a predetermined angle while said cleaning means is being operated for wet-cleaning, wherein said angle corresponds to at least one half of a full rotation; then (b) enabling said machine to carry out an image forming operation while said rotatable medium is kept rotating; then (c) continuing to rotate said rotatable medium; then (d) forming an electrostatic latent image on said rotatable medium and developing same with liquid developer to form a toner image and then transferring said toner image to transfer material.

24. In a method of operating an electrophotographic machine, wherein a latent image is formed on a rotatable recording surface at a latent image formation station and is wet developed, the resultant toner image is subsequently transferred to an image receiving material and the recording surface is thereafter cleaned at a cleaning station, the improvement wherein said recording surface, once operation of said machine is started and before latent image formation begins, is rotated through a predetermined angle while being wet-cleaned, wherein said angle corresponds to at least one half of a full rotation.

25. The improvement as claimed in claim 24, wherein said cleaning station contacts said recording surface and wherein developer liquid is supplied to the contact area between said recording surface and said cleaning station to facilitate wet-cleaning.

26. The improvement as claimed in claim 25, wherein the developer liquid supplied to the contact area is fed at a position wherein the rotatable surface rotates downwardly and wherein the developing station for wet-development is located below said position and adjacent to said rotatable surface.

27. The improvement as claimed in claim 24, wherein said recording surface, after termination of image transfer, is rotated further until it is cleaned over its entire length.

28. The improvement as claimed in claim 24, wherein said cleaning station contacts said recording surface and wherein, after the machine is turned on, developing liquid is first supplied to the contact area between said cleaning station and said recording surface and thereafter said recording surface is rotated through said angle.

29. The improvement as claimed in claim 24, wherein after the machine is turned on, said recording surface is rotated and thereafter a signal is generated in response to rotation of said recording surface for initiating the image-forming operation.

* * * * *